US005243808A

United States Patent [19]

Landrum

[11] Patent Number: 5,243,808

[45] Date of Patent: Sep. 14, 1993

[54] FLANGED CARTON SEALING APPARATUS AND METHOD

[75] Inventor: Charles R. Landrum, Dunwoody, Ga.

[73] Assignee: Kliklok Corporation, Decatur, Ga.

[21] Appl. No.: 938,623

[22] Filed: Sep. 1, 1992

[51] Int. Cl.[5] ..... B65B 7/16

[52] U.S. Cl. ..... 53/484; 53/374.4; 53/375.4; 53/376.2; 53/378.3; 493/144

[58] Field of Search ..... 493/135, 142, 144; 53/484, 373.3, 374.2, 374.3, 374.4, 375.4, 376.2, 376.5, 376.7, 377.4, 377.8, 378.3, 387.2, 387.3

[56] References Cited

U.S. PATENT DOCUMENTS

| | | | |
|---|---|---|---|
| 2,412,862 | 12/1946 | Bergstein | 53/375.4 X |
| 2,625,778 | 1/1953 | Wood | 53/387.2 X |
| 2,987,107 | 6/1961 | Sylvester et al. . | |
| 3,597,900 | 8/1971 | Scott | 53/377.8 X |
| 3,618,480 | 11/1971 | Theys et al. | 53/376.7 X |
| 3,619,977 | 11/1971 | Theys et al. . | |
| 3,713,952 | 1/1973 | Schafer et al. | 53/376.7 X |
| 3,813,846 | 6/1974 | Doering, Jr. et al. . | |
| 3,829,004 | 2/1993 | Graser . | |
| 4,249,978 | 2/1981 | Baker . | |
| 4,460,349 | 7/1984 | Charron | 493/142 X |
| 4,519,181 | 5/1985 | Sherman et al. | 53/377.4 |
| 4,562,687 | 1/1986 | Green, Jr. | 53/376.5 |
| 4,750,955 | 6/1988 | Haguenier . | |
| 4,767,390 | 8/1988 | Herring | 493/144 X |
| 4,894,104 | 1/1990 | Hemus | 53/387.2 X |
| 4,901,911 | 2/1990 | Drexhage . | |
| 4,969,306 | 11/1990 | Wallin . | |

FOREIGN PATENT DOCUMENTS

| | | |
|---|---|---|
| 1265648 | 4/1968 | Fed. Rep. of Germany . |
| 2442198 | 11/1978 | France . |

*Primary Examiner*—John Sipos
*Assistant Examiner*—Daniel Moon
*Attorney, Agent, or Firm*—King and Schickli

[57] ABSTRACT

An apparatus and related method for sealing paperboard cartons with overlapping flanges on the side panel and cover in a continuous operation is disclosed. At least one of the flanges is an inverted U-shaped flange extending outwardly from the side of the carton as the carton is moved along a longitudinal feed path by a conveyor. Adhesive is provided between the flanges and the flanges are pressed together by upper and lower rotary members; the lower member including an inwardly projecting segment mating with the underside of the inverted U-shaped flange so that the sealing can proceed without interference with the depending portions of the U-shaped flange. The projecting segment is mounted on a disc positioned outboard of the feed path so as to provide touch contact for self centering of the carton. The segment on the lower disc is elongated in the direction of the feed path and includes a series of ridges on the pressure face to increase the sealing effect. The disc operates at a speed faster than the conveyor which includes pusher lugs so as to allow release of the carton from the conveyor during the sealing operation. The height of the sealing members is adjustable in unison to accommodate cartons of different depth. A roller forms the upper rotary member and is pivotally mounted on an arm to allow floating action and easy manual release for interruption of the sealing operation.

17 Claims, 5 Drawing Sheets 50
51
31
30
60

12,13
f1, f2
C
35
36
32
31
30
C
36
35
15
10
16
70
ADJUSTMENT MEANS
72
71
71
30

FLANGED CARTON SEALING APPARATUS AND METHOD

TECHNICAL FIELD

The present invention relates to packaging machinery, and more particularly to an apparatus and related method for sealing paperboard cartons having overlapping flanges, at least one of which is an inverted U-shaped flange, in a continuous operation.

BACKGROUND OF THE INVENTION

One of the primary objectives being sought today by engineers in the packaging field is increased speed of operation. One of the critical factors in being able to successfully increase speed in a packaging line for paperboard cartons is the sealing of the carton in an efficient manner. Of course, efficiency presupposes that the carton can be sealed liquid tight so as to prevent leakage during use. One of the primary users of paperboard cartons is the food industry which makes it mandatory that sealing is accomplished taking into account both objectives; that is, high speed and liquid tightness.

Within the food industry, one of the most popular paperboard cartons today is the coated paperboard tray with a lid, either provided separately or as a part of an integral hinged cover. These trays are particularly adapted for packaging convenience food that can be prepared in the microwave oven. The most popular form of this carton or tray is shown in the present applicant's own U.S. Pat. No. 4,304,352 to Humphries, issued Dec. 8, 1981. As can be seen by reviewing this patent, the side panels and the lid are provided with mating flanges that are sealed together to form the liquid tight carton suitable for many products, but particularly suited for frozen food entrees or the like.

In the prior art, it is common practice to provide adhesive between the flanges, such as heat activated thermosetting adhesive and/or sprayed high contact adhesive, such as illustrated and claimed in applicant's prior U.S. Pat. No. 4,249,978 to Baker, issued Feb. 10, 1981. Once the adhesive is applied/activated, the carton is fed along a continuous operating conveyor with side positioned pressure members engaging the flanges for sealing. Since the flanges in the tray-type carton shown in the U.S. Pat. No. 4,304,352 are continuous along the sides of the carton and the side panels are angled outwardly, there is generally no problem in engaging the flanges to apply the pressure for the sealing process. A standard approach is to use two pairs of rollers, one pair on each side, for sealing the flanges on two sides; and then rotating the carton and sealing the other two sides by passing through two more pairs of rollers. A common approach to this manner of sealing is shown in the U.S. Pat. No. 4,969,306 to Wallin, issued Nov. 13, 1990.

However, in any situation where there is a complication in the shape of the carton or lid, or where special consideration must be given to some other operating factor, the only known successful approach, insofar as I am aware, is to feed the tray-like carton intermittently along the feed path and then apply the lid at one stop station and seal the lid at a downstream stop station. A typical approach with respect to this type of special packaging machine is shown in the Oxborrow U.S. Pat. No. 4,626,234, issued Dec. 2, 1986. As will be readily recognized, the objective of increased speed of operation must be completely abandoned when this approach is taken.

Recently, an innovation in carton design has led to the introduction of a special tray-type carton that requires special consideration for sealing. The particular carton innovation provides at least one of the flanges of the side panel or cover of the carton as an inverted U-shaped flange extending outwardly from the side. Also, the side panels of the carton extend substantially perpendicular rather than slanted outwardly, as is more common, such as shown in the Humphries U.S. Pat. No. 4,304,352.

As illustrated in the U.S. Pat. No. 4,626,234, the first and apparently only approach suggested by the prior art, is to seal the carton flanges of the side panels and cover by intermittent feed with a reciprocating platen at a stop station. It can be readily recognized that the use of rotating presser rollers along the sides of the conveyor does not work due to the inevitable interference provided by the depending portions of the U-shaped flange. Thus, prior to the present invention, engineers were stuck with using the intermittent feed/reciprocating platen sealing arrangement.

As recognized by those skilled in the art, the carton construction with the inverted U-shaped flanges provides a significant strengthening of the carton, as well as providing convenient side handles.

Thus, it would be very desirable to be able to take advantage of the new carton if the benefits of continuous operation along the conveyor feed path can also be obtained.

SUMMARY OF THE INVENTION

It is thus a primary object of the present invention to provide an apparatus and method for sealing a tray-like carton having flanges of a special design, and overcoming the machinery shortcomings of the prior art, as described.

It is another object of the present invention to provide an apparatus and method for sealing a tray-like carton having cooperating flanges on the side panels and cover, and wherein at least one of the flanges is an inverted U-shaped form for strengthening the carton and providing convenient handles.

It is still another object of the present invention to provide the arrangement for sealing side flanges of a carton with at least one of the flanges being an inverted U-shaped form by use of upper and lower rotary members pressing the flanges together as the carton continues to move in a continuous manner.

It is still another object of the present invention to provide a sealing arrangement for a carton of the type described wherein a rotary disc having inwardly directed segments mates on the underside of the inverted U-shaped flange providing continuous, maximum speed of operation.

Another object of the present invention is to provide an apparatus and method for sealing side flanges of a carton including at least one inverted U-shaped flange wherein the sealing is not only continuous but provides for advantageous acceleration of the carton during sealing, centering of the carton from side to side on the conveyor and other beneficial functions and operating concepts.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a continuous operating carton sealing arrangement is provided for sealing of overlapping flanges on the side panel and lid/cover for the new style carton having at least one inverted U-shaped flange. In order to provide this improvement over the prior art, the present invention contemplates a conveyor for moving each carton along a longitudinal feed path in a continuous fashion with means for providing adhesive between the flanges. Upper and lower rotary means are provided downstream for pressing the flanges together to form the sealing function. The lower rotary means includes an inwardly projecting segment mating with the underside of the inverted U-shaped flange so as to avoid interference with the depending portions of the flange. As will be realized, this concept allows continuous feeding thus accomplishing the main objectives of an increased rate of feed, as well as highly efficient seal formation.

In accordance with a more limited aspect of the present invention, the lower rotary means takes the form of a rotating disc positioned outboard of the feed path so that the disc itself is clear of the carton moving along the feed path, as defined by the conveyor. The pressure face of the inwardly directed segment on the disc is preferably of a length substantially equal to the cross portion of the U-shaped flange for alignment. This provides full length sealing of the cross portion from corner-to-corner formed with the two depending portions of the U. By providing rotary discs on both sides of the carton, the two sides of the carton can be sealed in unison. Also, a feature of the invention is for each disc to provide an inside face separate from the segments for touch contact of the edges of the flanges to self center the carton during the continuous movement.

It is also important that the drive for the upper and lower rotary members operate at a speed slightly faster than the conveyor, and for the conveyor to include pusher lugs. This provides for release of the carton from the conveyor during sealing.

In order to accommodate different cartons, means is provided to adjust both the width and height of the rotary pressure sealing means. The upper rotary member is preferably a roller of sufficient width to engage the cross portion of the U-shaped flange opposite the lower rotary member including the segments so as to provide the maximum sealing pressure. The upper roller is also pivotally mounted for free floating action during sealing and may be manually raised for interruption of the sealing operation. Longitudinal ridges on the segment are provided to increase the sealing effect by concentrating the force in a limited area.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawings.

DETAILED DESCRIPTION OF THE PREFERRED EMBODIMENT

Figure 1:
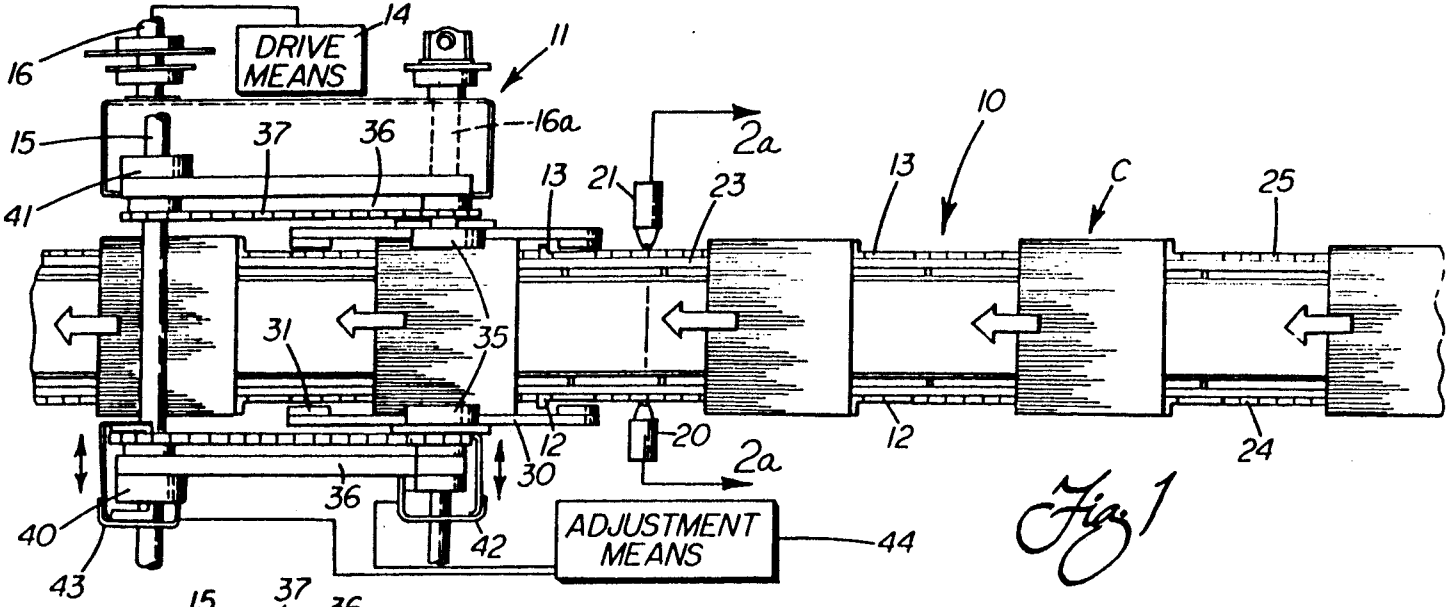
FIG. 1 is a top view illustration of a continuous operating conveyor with paperboard cartons of the new design and extending through a sealer assembly constructed in accordance with the present invention.

With reference now to FIG. 1 of the drawings, there is illustrated a portion of a packaging machine in the form of a continuously operating conveyor 10 and a downstream sealer or closing assembly 11. As illustrated, a series of cartons C have already had the cover/lid placed on the top and a front flange sealed against the front or leading edge of the carton. As mentioned above, the sealing of the front flap, or the front and rear flanges depending on the type of carton being used, is performed in the known manner and after which the carton C is rotated 90° and moved into position as shown in this figure.

Figure 2:
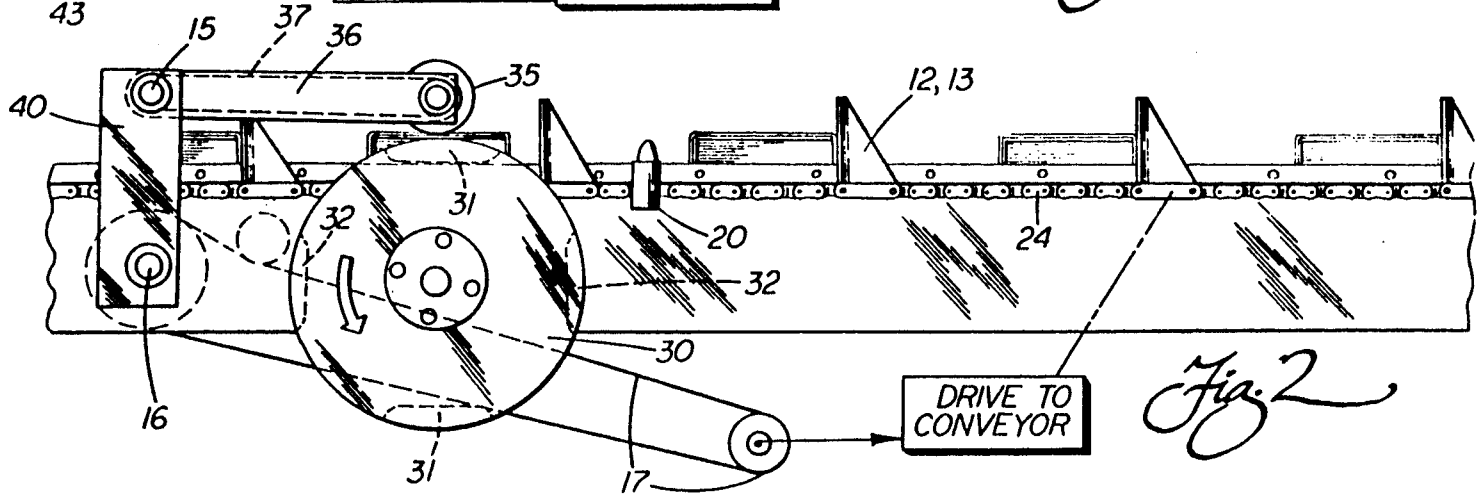
FIG. 2 is a side elevational view of the conveyor and sealer assembly illustrated and described with respect to FIG. 1.

The cartons C are driven along the longitudinal feed path by spaced pushers 12, 13 (see also FIG. 2). A drive means 14, which can be any type of conventional packaging machine drive, such as an electric motor with variable speed capability, and including such advanced motor forms as servo or stepper motors, are connected to upper and lower drive shafts 15, 16 in the sealer assembly 11. A drive take-off 17 is connected to the lower drive shaft 16 in order to transmit the drive to the conveyor 10.

Figures 1A, 3A:
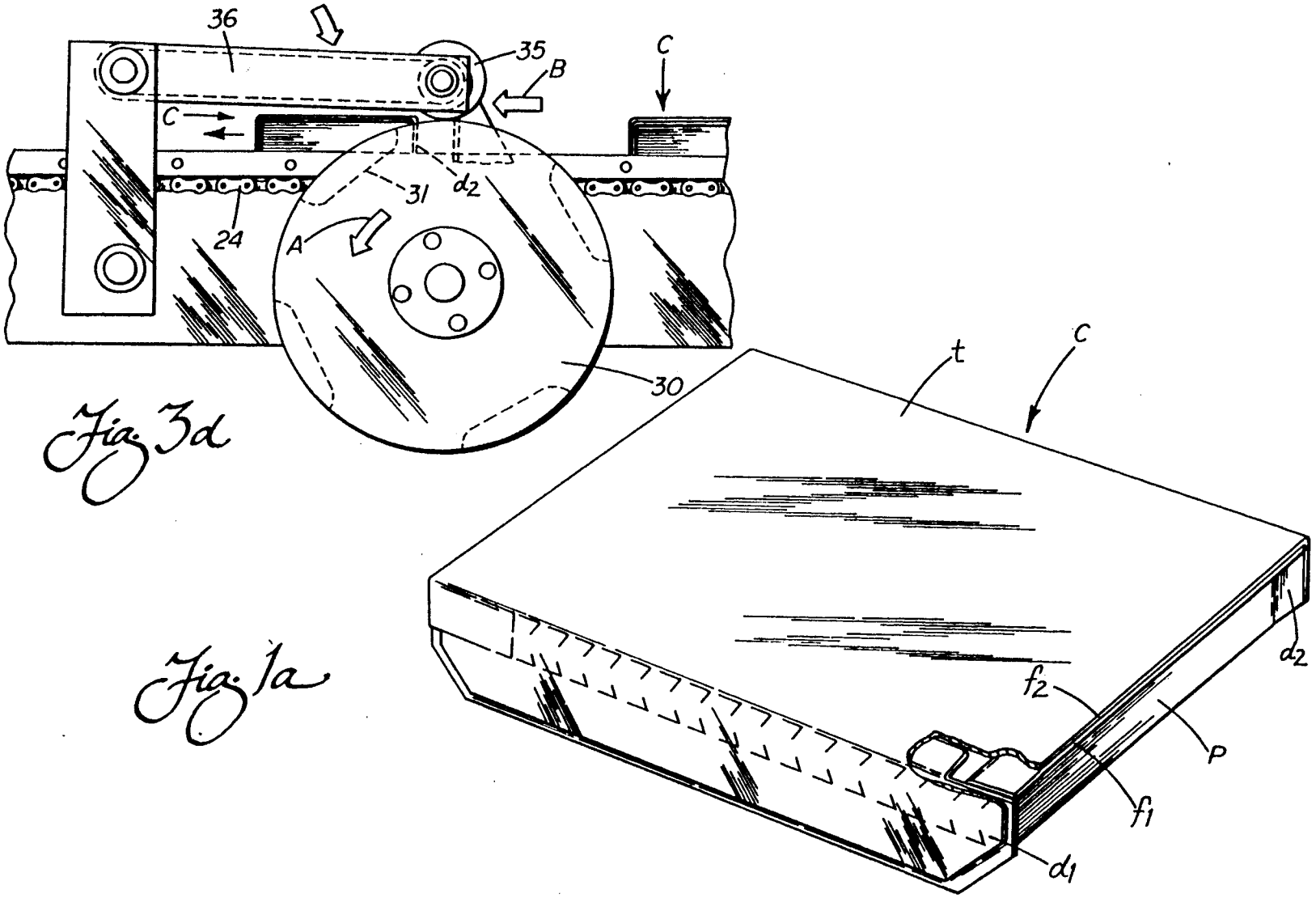
FIG. 1*a* is a perspective view of the new carton design for which the apparatus/method is particularly adapted.
FIG. 3*a* is a side view similar to FIG. 3 but taken at a later time when the sealing segment engages the inverted U-shaped flange moving the carton forward away from the pusher lug of the conveyor and just before engagement with the upper roller for sealing.

Reference is now made to FIG. 1*a* to provide a more detailed view of the carton for which the conveyor 10 and sealer assembly 11 is particularly adapted for sealing. Thus, the carton C includes overlapping flanges $f_1$ and $f_2$ extending from the side panel p and the top or cover t. At least one of the flanges, and in the preferred embodiment both flanges are comprised of inverted U-shaped members including a cross portion and depending portions $d_1$, $d_2$. The depending portions are corner forming gussets that have been left extending outwardly rather than folded against the side panel p. In this manner, the sides of the carton C are substantially reinforced and the flanges $f_1$, $f_2$, as well as the depending portions $d_1$, $d_2$ provide convenient handles for the carton.

Positioned along the feed path of the conveyor 10 is a pair of hot air nozzles 20, 21 (see also FIG. 2*a*) designed to activate the coating on the flanges $f_1$, $f_2$ for sealing. As indicated above, providing the adhesive may also include a spray nozzle for an adhesive (not shown).

Figure 2A:
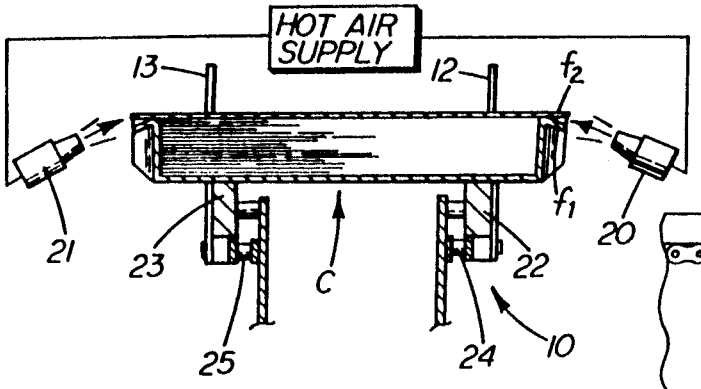
FIG. 2*a* is a cross section view taken along line 2*a*—2*a* of FIG. 1 and illustrating one approach for providing adhesive between the flanges.

As can also be best seen in FIGS. 1 and 2*a*, the conveyor 10 includes spaced guide rails 22, 23 upon which the carton C is positioned for sliding during the feeding along the feed path. In order to move the pusher lugs 12, 13 a pair of drive chains 24, 25 are provided (see also FIG. 3). The drive chains are interconnected by drive linkage (not shown) to the drive take-off 17, as shown in FIG. 2.

Figure 3:
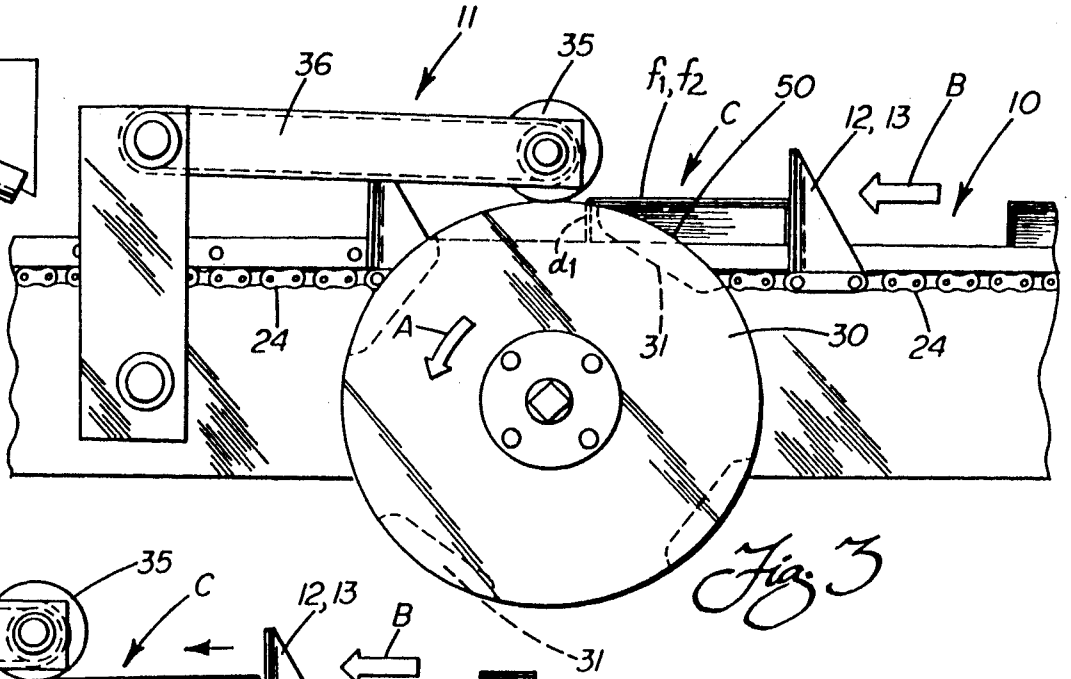
FIG. 3 is a side view similar to FIG. 2 with parts omitted for clarity illustrating the initial interaction between the sealing segments and the flanges on the carton being moved continuously forward by the conveyor means.

In accordance with an important aspect of the present invention, a rotary member, in the form of a circular disc 30 is mounted on the conveyor 10 for driving by the drive means 14 through forward drive shaft 16*a*. The disc includes a plurality of curved segments, as shown in FIGS. 1, 2 and 3, and as identified by pairs of segments 31, 32 (see FIGS. 2 and 3 in particular). In the preferred embodiment shown, the pair of segments 31 are operative to engage the inverted U-shaped flanges $f_1$, $f_2$ for sealing on successive cartons C.

An upper rotary member, in the form of a roller 35 is provided for cooperation with the segments 31 to provide firm pressure to seal the flanges $f_1$, $f_2$ together. The roller 35 is mounted on a pivotal arm 36 to provide downward, floating pressure. A drive chain 37 is employed to rotate the roller 35 in timed relationship to the cooperating disc 30 and segments 31.

As shown in FIG. 2, the pivotal mounting of the arm 36 is provided by a bearing interface on the upper drive shaft 15 which is supported by stationary support arms 40, 41. Adjustable mounts 42, 43, as best shown in FIG. 1, allow in and out adjustment of the disc 30, the roller 35 and supports 40, 41 through suitable adjustment means 44. In this manner, the width of the sealer assembly 11 can be adjusted in order to provide for different width cartons C.

Figures 3E, 4, 5:
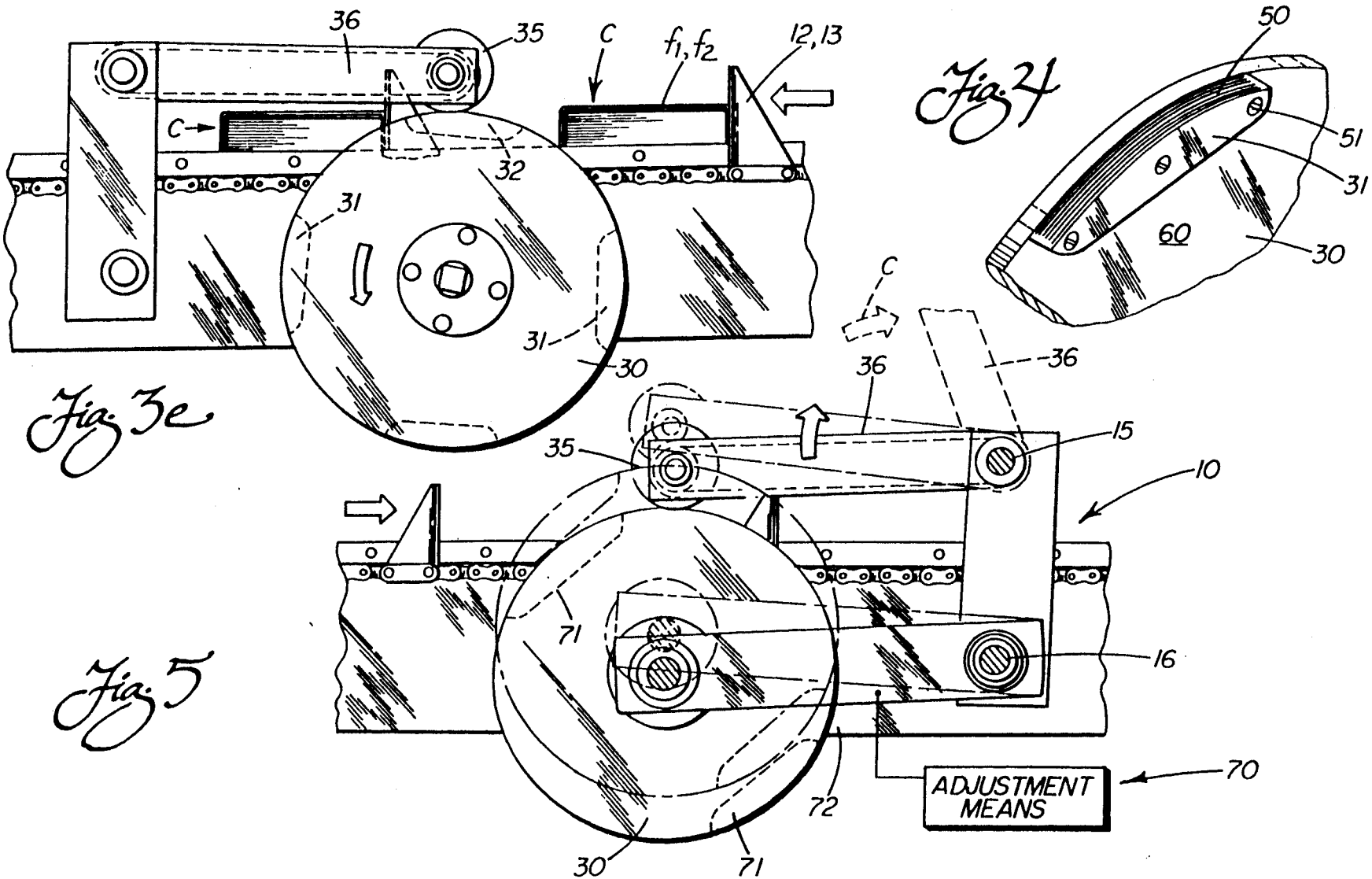
FIG. 4 is an enlarged partial perspective view of a peripheral portion of the lower rotary disc with the grooved segment for sealing.
FIG. 5 is a cross sectional view through the center of the conveyor and sealer assembly illustrating the manner of vertical adjustment and raising of the upper roller for interruption of the sealing operation.

With reference now to FIGS. 3–3*e*, a more complete review of the operation of the sealer assembly 11, and the related method of the present invention, can be provided. The pusher lugs 12, 13 connected to the drive chains 24, 25 of the conveyor 10 move each carton C in succession into the sealer assembly 11. The timing through the drive means 14, the shafts 15, 16, 16*a* and the drive take-off 17, is such as to assure the arrival of segment 31 on the disc 30 in proper timed sequence. Pressure face 50 of the segment 31 is moved into position on the underside of the depending, inverted U-shaped flanges $f_1$, $f_2$. As can best be seen in FIG. 4 of the drawings, the segment 31 may be attached by any suitable fasteners 51 to the disc 30. This allows for easy replacement of the appropriate size segments for other size cartons.

Preferably, the pressure face 50 includes a plurality of longitudinally extending ridges (note FIG. 4) in order to increase the sealing effect between the flanges. This enhanced sealing is due to the increased force that is provided by engagement of the limited area along the upper crest of the ridges with the underside of the inverted U-shaped flange $f_1$. It is also apparent that the longitudinal length of the pressure face 50 of the segment 31 is substantially equal to the length of the flange $f_1$.

The rotation of the disc 30, as noted by the action/speed arrow A in FIG. 3, moves pressure face 50 at a speed slightly in excess of the speed of the pusher lugs 12, 13, as denoted by the action/speed arrow B. This is important to allow the segment 31 to rotate into position underneath the flanges $f_1$, $f_2$ and catch up with the carton C without providing interference with the leading depending portion $d_1$.

As indicated, the width of the segment 31 is substantially the same as the flanges $f_1$, $f_2$ that extend outwardly from the side of the carton C. This means that inwardly directed side face 60 (apart from the segment 31; see FIG. 4) of the disc 30, is positioned just outside the feed path so as to clear the flanges $f_1$, $f_2$ and particularly avoid interference with the leading and trailing depending portions $d_1$, $d_2$. Also, with this arrangement, the inside face 60 separate from the segments 31 is positioned for touch contact with the flanges $f_1$, $f_2$, at least along the outer edges of the depending portions $d_1$, $d_2$, and as a result the carton C is self centered along the conveyor 10 during movement along a feed path.

The advantageous result of the differential speeds of the disc 30 and the pusher lugs 12, 13 (denoted by the action/speed arrows A, B) can be further seen in the next sequence of FIG. 3*a*. At this point, the operative segment 31 catches up with the leading depending portion $d_1$ and advances the carton C away from its pusher lugs 12, 13. Thus, the carton C is released from the conveyor 10 during the sealing operation.

Figure 3A:
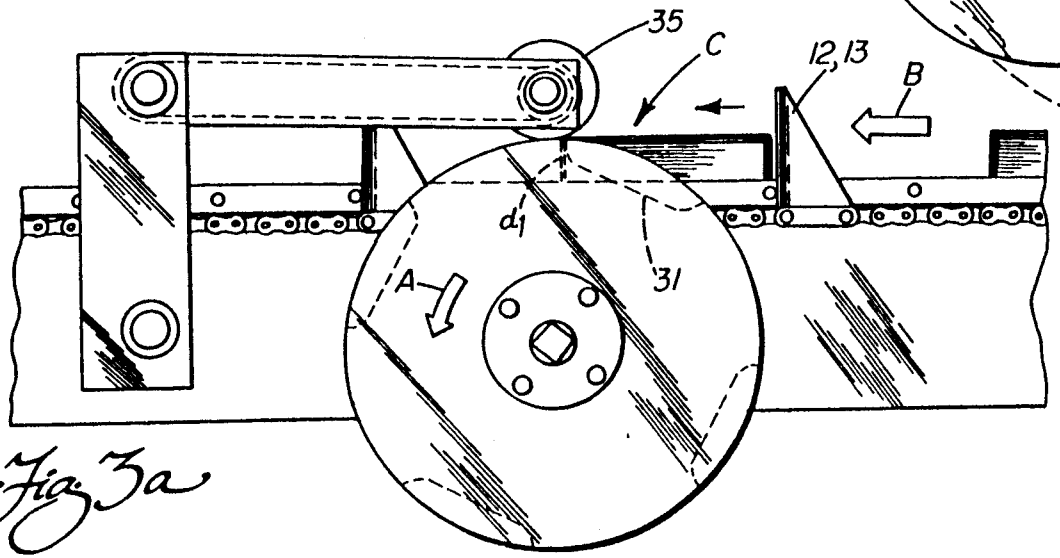
Figure 3B:
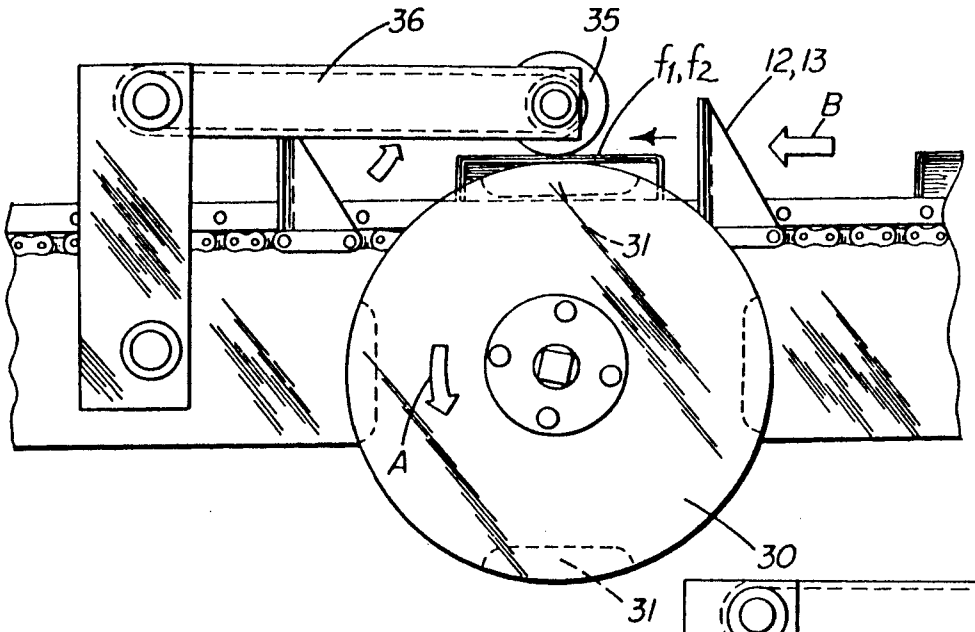
FIG. 3*b* is the next in sequence illustration showing the upper and lower rotary members pressing the flanges together with the segment being centered on the underneath side of the U-shaped flange (see FIGS. 1 and 2, which have the same relationship)

Moving now to the illustration of FIG. 3*b*, the upper roller 35 now lifts up onto the flanges $f_1$, $f_2$ and begins to pressure seal the first half of the sealing area. The roller 35 has sufficient width to engage the flanges $f_1$, $f_2$ opposite the edge of the disc 30, as well as the pressure face 50 of the segment 31. The weight of the roller 35 and the arm 36 assures proper liquid tight sealing pressure, as desired.

Figure 3C:
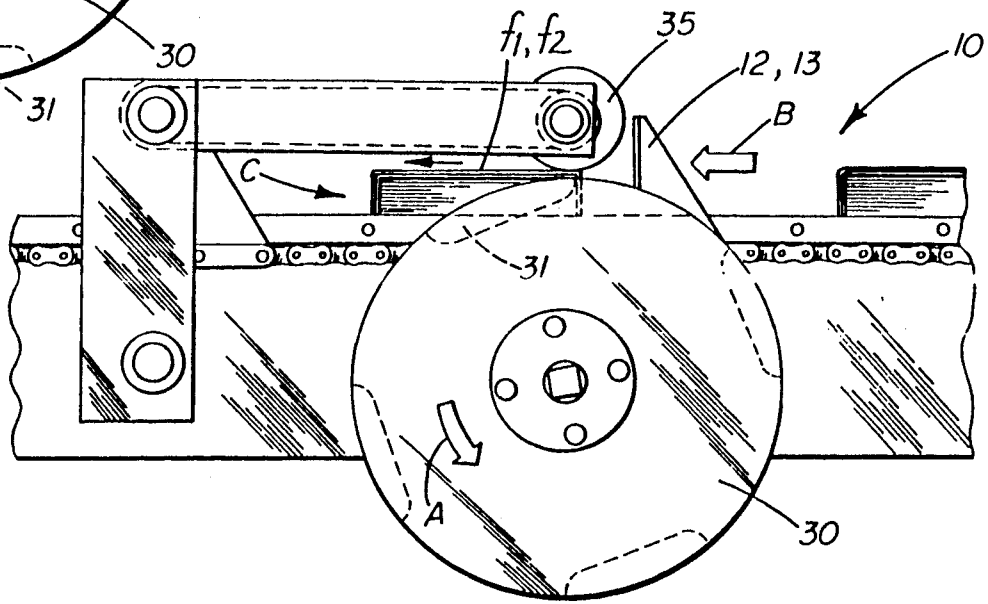
FIG. 3*c* is the next in time lapse showing the position wherein the segment is engaged with the trailing edge of the flange to complete the sealing operation, FIG. 3*d* illustrating the faster segment moving away from the carton, the upper roller member dropping down against the lower rotary member with the pusher lug starting to close the gap toward the rear of the carton, and FIG. 3*e* illustrating the positioning of the components of the sealer assembly at the time between the carton just sealed and the next in line carton for sealing.

With reference now to FIG. 3*c*, the disc 30 rotates to the final sealing position so that the entire extent of sealing between the flanges $f_1$, $f_2$ of corner-to-corner of the inverted U-shaped flange, is complete. As shown, the differential speeds, illustrated by arrows A, B, allows the carton C to move still further away from the pusher lugs 13, 14. As will now be more fully realized, firm sealing of the flanges $f_1$, $f_2$ without interference from the conveyor 10 is a feature of the invention, since during the entire pressure sealing operation the segment 31 cooperating with the opposed roller 35 is relied upon for exclusive movement of the carton C, and release from the conveyor 10.

Following next in the sequential position of the components is FIG. 3*d;* the carton C is now fully sealed along the flanges $f_1$, $f_2$ and the segment 31 is allowed to pull free and out of the way to avoid interference with the trailing depending portion $d_2$. This is also accomplished by the differential speed represented by arrows A, B and assures completion of the successful sealing function. At this point, the arm 36 supporting the upper roller 35 is allowed to drop onto the rim of the disc 30. The disc 30 continues to rotate in readiness for sealing of the next in line carton C on the conveyor 10.

Once the leading carton C is released by the forward independent driving force of the disc 30 and the roller 35, it momentarily pauses since at this point it is supported without a forward driving force on the support rails 22, 23 (see FIG. 2*a* and 3*e*). The support arm 36 remains in the lowered position and the roller 35 passes over the next in line segment 32, which in the embodiment shown is not utilized for a sealing function. Instead, the continued rotation of the disc 30 brings the next sealing segment 31 into position for engagement with the flanges $f_1$, $f_2$ of the next in line carton C, and the process of sealing is repeated.

A suitable adjustment means, generally designated by the reference numeral 70 may be provided to raise the height of the rotating disc 30 on pivotal arm 72 and roller 35 on the arm 36, as shown in FIG. 5. Specifically, as with the support arm 36, the support arm 72 is mounted for relative rotation in a standard fashion on the lower drive shaft 16. As the arm 72 is raised, the roller 35 is also raised because of its free floating mounting on the upper drive shaft 15. This automatically provides a sealing arrangement for cartons of increased depth. It will be also noted in this figure that only two sealing segments 71 are shown, and are extended in length to illustrate the fact that cartons, also with greater length than the carton C can be successfully sealed.

Also, as shown by the dotted action arrow C, the arm 36 is free to be manually raised to an inoperative position for interruption of the sealing operation. This feature is particularly useful in start-up of the machine assuring proper placement of the cartons C along the length of the conveyor 10.

In summary, the sealer assembly 11, and the related method of sealing provides substantial benefits over the prior art for operation on packages of special design, specifically with respect to a carton C having overlapping flanges $f_1$, $f_2$ on the side panel p and the top or cover t. Efficient sealing is accomplished by operation of the inwardly projecting segment 31 providing a pressure face 50 engaging the underside of the cross portion of said flanges. Advantageously, the depending portions $d_1$, $d_2$ of the flanges are avoided thus preventing interference that would otherwise occur with the continuous sealing arrangements of the prior art. A substantial benefit is provided by being able to allow continuous operation and feed of the carton C utilizing this apparatus and related method.

The concept of driving the disc 30 with the segments 31 and the cooperating roller 35 at a speed in excess of the pusher lugs 12, 13 allows the cartons C to be released from the conveyor 10, and thus carefully controlled to further enhance the sealing operation. The trailing edge of the carton C is relieved from engagement with the pusher lugs 12, 13 until such time as the segment 31 has completely withdrawn from the sealing position (see FIG. 3*e*). To further increase the sealing efficiency, the pressure face 50 of the segment 31 preferably includes longitudinally extending ridges (see FIG. 4).

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A method of sealing paperboard cartons having overlapping flanges on the side panel and cover thereof, at least one of the flanges being a composite inverted U-shaped flange extending outwardly from the side of the carton including a top flange and two downwardly extending side flanges, the steps comprising:

moving each carton in sequence and in a continuous fashion along a longitudinal feed path on a conveyor parallel to said top flange;

providing adhesive means between said overlapping flanges as the carton is moving;

pressing said flanges together with sufficient force to seal the carton by engagement of the flanges by upper and lower pressure members;

the lower pressure member being a rotary member with an axis perpendicular to said path;

providing an inwardly projecting elongated segment on the lower rotary member projecting axially inwardly for mating with the underside of the top flange of the composite inverted U-shaped flange;

whereby the flanges are sealed without interference with the depending side flanges of the U-shaped flange.

2. The method of sealing paperboard cartons in accordance with claim 1, wherein is further provided the step of aligning the segment so as to extend substantially along the length of the top flange of said U-shaped flange during sealing.

3. The method of sealing paperboard cartons in accordance with claim 2, wherein is further provided the step of simultaneously sealing the flanges on both sides of the carton, and aligning the carton along the feed path by touch contact so as to self center the carton during movement along said feed path.

4. The method of sealing paperboard cartons in accordance with claim 1, wherein is further provided the step of operating the lower rotary member at a speed faster than the operation of said conveyor so as to move the carton forward and allow release from said conveyor during the sealing operation.

5. The method of sealing paperboard cartons in accordance with claim 1, including the additional step of pivotally mounting said upper rotary member to allow floating action during sealing.

6. In a continuous operating apparatus for sealing paperboard cartons having overlapping flanges on the side panel and cover thereof, at least one of said flanges being a composite inverted U-shaped flange extending outwardly from the side of the carton including a top flange and two downwardly extending side flanges, the improvement comprising:

a conveyor for moving each carton in sequence along a longitudinal feed path parallel to said top flange;

means for providing adhesive means between said overlapping flanges;

upper pressure means and lower rotary pressure means rotating about an axis perpendicular to said path for pressing said flanges together with sufficient force to seal the flanges; and the lower rotary means including a segment projecting axially inwardly and having a pressure face for mating with the underside of the top flange of the inverted U-shaped flange;

whereby the flanges can be sealed without interference with the depending side flanges of said U-shaped flange.

7. In a continuous operating apparatus for sealing paperboard cartons having overlapping flanges on the side panel and cover thereof, at least one of said flanges being a composite inverted U-shaped flange extending outwardly from the side of the carton including a top flange and two downwardly extending side flanges, the improvement comprising:

a conveyor for moving each carton in sequence along a longitudinal feed path parallel to said top flange of the carton;

means for providing adhesive means between said overlapping flanges;

upper and lower rotary means rotating about axes perpendicular to said path for pressing said flanges together with sufficient force to seal the flanges; and the lower rotary means including a segment projecting axially inwardly and having a pressure face for mating with the underside of said top flange of the inverted U-shaped flange;

whereby the flanges can be sealed without interference with the side flanges of said U-shaped flange.

8. The sealing apparatus of claim 7 wherein said lower rotary means includes a disc positioned axially outboard of said feed path so as to clear said flanges, the pressure face of said segment being length substantially equal to the cross portion of said U-shaped flange for alignment during sealing.

9. The sealing apparatus of claim 8 wherein is provided a rotary disc on each side of said carton to simultaneously seal the flanges on both sides, the inside face of the disc separate from said segments being positioned for touch contact to self center the carton during movement along the feed path.

10. The sealing apparatus of claim 8 wherein said top flange and side flanges of said composite inverted U-shaped flange defines corners in between, the pressure face of said segment extending from corner-to-corner for high efficiency sealing of said top flange.

11. The sealing apparatus of claim 7 wherein is provided drive means for said upper and lower rotary means operating at a speed faster than said conveyor and said conveyor includes pusher lugs so as to allow release of said carton from said conveyor during sealing.

12. The sealing apparatus of claim 7 wherein is provided means to adjust the width and height of said upper and lower rotary means in unison to accommodate cartons of different size.

13. The sealing apparatus of claim 7 wherein said upper rotary means comprises a roller having sufficient width to engage the flange opposite said lower rotary means including said segments during the sealing operation.

14. The sealing apparatus of claim 13 wherein said upper roller is pivotally mounted on an arm to allow floating action during sealing.

15. The sealing apparatus of claim 14 wherein said arm is free to be manually raised to an inoperative position for interruption of the sealing operation.

16. The sealing apparatus of claim 7 wherein the segment is elongated in the longitudinal direction corresponding to the movement along the feed path, the outer pressure face of said segment including a series of ridges to increase the sealing effect between the flanges.

17. The sealing apparatus of claim 16 wherein the ridges run in the longitudinal direction along said segment.

* * * * *